United States Patent [19]

Yamada

[11] 4,121,559

[45] Oct. 24, 1978

[54] LUBRICANT OIL PUMP FOR TWO-CYCLE ENGINES

[75] Inventor: Seiichiro Yamada, Hamamatsu, Japan

[73] Assignee: Yamaha Hatsudoki Kabushiki Kaisha, Iwata, Japan

[21] Appl. No.: 754,404

[22] Filed: Dec. 27, 1976

[30] Foreign Application Priority Data

Dec. 29, 1975 [JP] Japan ..... 50-158839

[51] Int. Cl.[2] ..... F01M 1/00

[52] U.S. Cl. ..... 123/196 R; 184/27 R

[58] Field of Search ... 123/73 AD, 140 MP, 140 MC, 123/196 R; 60/601; 184/27 R, 32, 33; 417/214, 218

[56] References Cited

U.S. PATENT DOCUMENTS

| | | | |
|---|---|---|---|
| 2,183,035 | 12/1939 | Weber et al. | 123/140 MP |
| 2,621,674 | 12/1952 | DuRosta | 123/140 MP |
| 2,734,729 | 2/1956 | Loftin | 123/140 MP |
| 2,776,720 | 1/1957 | Reggio | 60/601 |
| 2,796,055 | 6/1957 | Cornelius | 123/140 MC |
| 2,894,735 | 7/1959 | Zupanic | 123/140 MC |
| 2,927,570 | 3/1960 | Pringham | 123/140 MP |
| 3,064,636 | 11/1962 | Dahl | 123/140 MP |
| 3,386,427 | 6/1968 | Powell et al. | 60/601 |
| 3,757,796 | 9/1973 | Boue et al. | 123/140 MP |
| 4,036,326 | 7/1977 | Muhai et al. | 184/33 |

*Primary Examiner*—Charles J. Myhre
*Assistant Examiner*—David D. Reynolds
*Attorney, Agent, or Firm*—Fleit & Jacobson

[57] ABSTRACT

Positive displacement type oil pump for two cycle engines, which is variable in displacement. The pump is provided with a pressure responsive diaphragm which is used to control the pump displacement. The diaphragm is subjected to the engine exhaust gas pressure so that the pump displacement is controlled in response to a change in the engine speed as well as to a change in the engine throttle valve opening.

5 Claims, 4 Drawing Figures

LUBRICANT OIL PUMP FOR TWO-CYCLE ENGINES

The present invention relates to internal combustion engines and more particularly to lubricant oil pumps for such engines.

In conventional two cycle engines, supply of lubricant oil has been provided by using so-called mixed gasoline in which gasoline is added with a predetermined ratio of lubricant oil, or by employing a lubricant oil pump for supplying lubricant oil separatly to the engine intake system. The engine system using the "mixed gasoline" does not require any specific means for supplying lubricant oil so that it is advantageous from the viewpoint of the engine structure. However, the system is disadvantageous in that the amount of supply of lubricant oil cannot be controlled as desired. In fact, if the mixing ratio of gasoline to lubricant oil is so determined that a suitable supply of lubricant oil is maintained under a heavy load engine operation, excessive amount of oil will be supplied in other operating conditions.

Therefore, lubricant oil pumps are now widely employed in conventional engines. Conventional oil pumps generally include two different types, one being a constant displacement type and the other a variable displacement type. In the latter type, the pump displacement is controlled in accordance with the engine throttle valve position.

In the oil supply system using the oil pump of constant displacement type, problems have been encountered in that, when the oil pump is so adjusted that a suitable amount of supply of lubricant oil is provided in high speed and heavy load engine operation, excessive amount of oil is supplied in other engine operating conditions.

Oil pumps of variable displacement type cannot provide satisfactory oil supply characteristics throughout the eingine operation when the pump displacements are controlled in accordance with the engine throttle valve positions. For example, when the pump is so adjusted that a suitable amount of lubricant oil supply is ensured in heavy load and high speed engine operation, excessive amount of oil will be supplied in heavy load and low speed engine operation while the supply of lubricant oil will become insufficient in light load and high speed engine operation.

In general, the amount of supply of lubricant oil for each stroke of engine operation must be increased in response to an increase in the engine speed even under a constant load because there are increases in inertia forces in the moving parts of the engine, such as the piston, the connecting rod, etc. Further, even under a constant engine speed, the supply of lubricant oil must be increased in response to an increase in load because the contact pressure at sliding parts increases as the load increases. In the known lubricant oil supply system, however, the above requirements cannot be satisfactorily met.

It is therefore an object of the present invention to provide an engine lubricating system in which the amount of oil supply can be appropriately controlled in accordance with the load and speed of the engine.

Another object of the present invention is to provide an engine lubricating oil supply system having variable displacement pump means of which displacement is controlled in accordance with a factor representing the load and speed of the engine.

According to the present invention, in order to accomplish the above and other objects, the lubricating oil supply system includes variable displacement type lubricating oil pump means comprising pressure responsive displacement control means which is adapted to be subjected to a pressure which changes in the same manner in response to an increase in engine speed and to an increase in engine throttle valve opening. In usual internal combustion engines, the pressure of the combustion gas as exhausted from the engine cylinder is considered as having the above characteristics. Therefore, the exhaust gas pressure is employed for controlling the pump displacement. The intake pressure at the downstream side of the engine throttle valve is not recommendable to be used for the purpose because it does not exactly represent the amount of intake gas. In fact, the pressure negative downstream of the engine throttle valve decreases in response to an increase in the throttle opening under a constant engine speed while it increases in response to an increase in the engine speed under a constant throttle valve opening.

The above and other objects and features of the present invention will become apparent from the following descriptions of a preferred embodiment taking reference to the accompanying drawings, in which.

Figure 1:
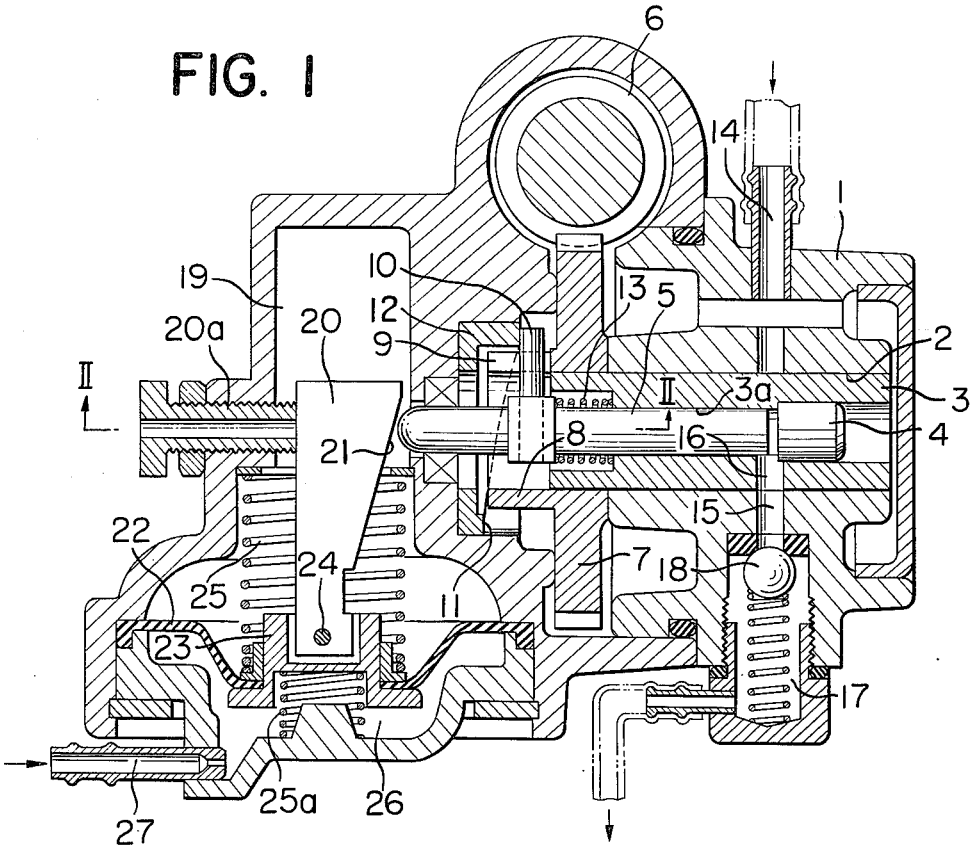
FIG. 1 is a sectional view of a lubricant oil pump which can be used in the present invention.
Figure 2:
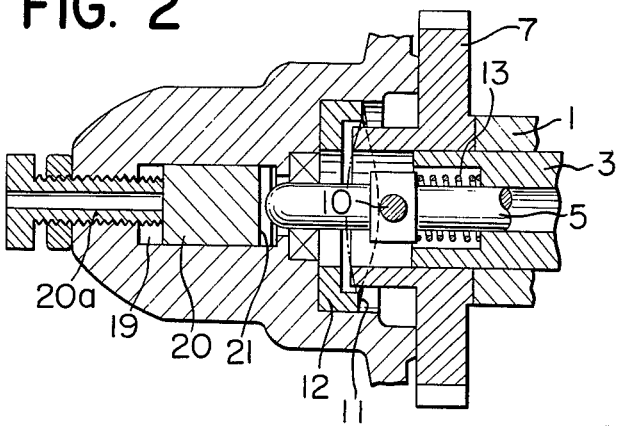
FIG. 2 is a sectional view taken substantially along the line II—II in FIG. 1.

Referring to the drawings, particularly to FIGS. 1 and 2, the lubricant oil pump shown therein includes a pump housing 1 which has a cylindrical bore 2 and a pump sleeve 3 rotatably received in the bore 2 of the housing 1. The sleeve has an axial bore 3*a* which is closed at one end by a plug 4. A pump plunger 5 is axially slidably inserted into the bore 3*a* from the other end.

The pump sleeve 3 has a worm wheel 7 which is secured thereto and meshing engagement with a worm 6 which is driven by engine crankshaft at a speed proportional to the engine speed. Thus, the worm wheel 7 and the pump sleeve 3 are rotationally driven by the worm 6. The worm wheel 7 has an axially extending boss 8 which is provided with an axial slot 9. The plunger 5 is provided with a radially extending pin 10 which is adapted to engage the slot 9 in the boss 8 of the worm wheel 7.

In the housing 1, there is mounted a cam 12 having a cyclically varying cam surface 11 which is located opposite to the boss 8 of the worm wheel 7. The plunger 5 is biased leftwards by a spring 13 so that the pin 10 is in engagement with the cam surface 11. Therefore, the arrangement is such that, as the worm 6 is rotated, the worm wheel 7 and the sleeve 3 is rotated and at the same time the plunger 5 is also rotated through the engagement between the pin 10 and the slot 9. Since the pin 10 is in engagement with the cam surface 11, the plunger 5 is axially reciprocated in accordance with the cam contour as it rotates. Thus, the maximum stroke of the reciprocating movement of the plunger 5 is determined by the cam contour.

The pump housing 1 is further provided with an oil inlet port 14 and an outlet port 15. The sleeve 3 has a radially extending port 16 which is adapted to communicate with the inlet port 14 during the intake stroke wherein the plunger 5 moves toward left as seen in FIG. 1 and with the outlet port 15 in the discharge stroke wherein the plunger 5 moves toward right. The outlet port 15 is provided with a one-way valve 18 through which the port 15 communicates with the outlet chamber 17.

The pump further includes a displacement adjusting mechanism which comprises a cam member 20 disposed in the housing 1 slidably along a guide groove 19. The cam member 20 has a cam surface 21 which is adapted to engage the outer end of the plunger 5.

In the housing 1, there is provided a pressure responsive diaphragm 22 having a cam support member 23 secured thereto. The cam member 20 is attached pivotably at its lower end to the cam support member 23 by means of a pin 24. The displacement 22 thus supporting the cam member 20 is biased downwardly by a relatively strong spring 25. A pressure chamber 26 is defined beneath the diaphragm 22 and a relatively weak spring **25*a* is disposed in the chamber 26 to bias the diaphragm 22 upwardly. The position of the cam 20 can be adjusted by means of an adjusting screw 20*a***.

Figure 3:
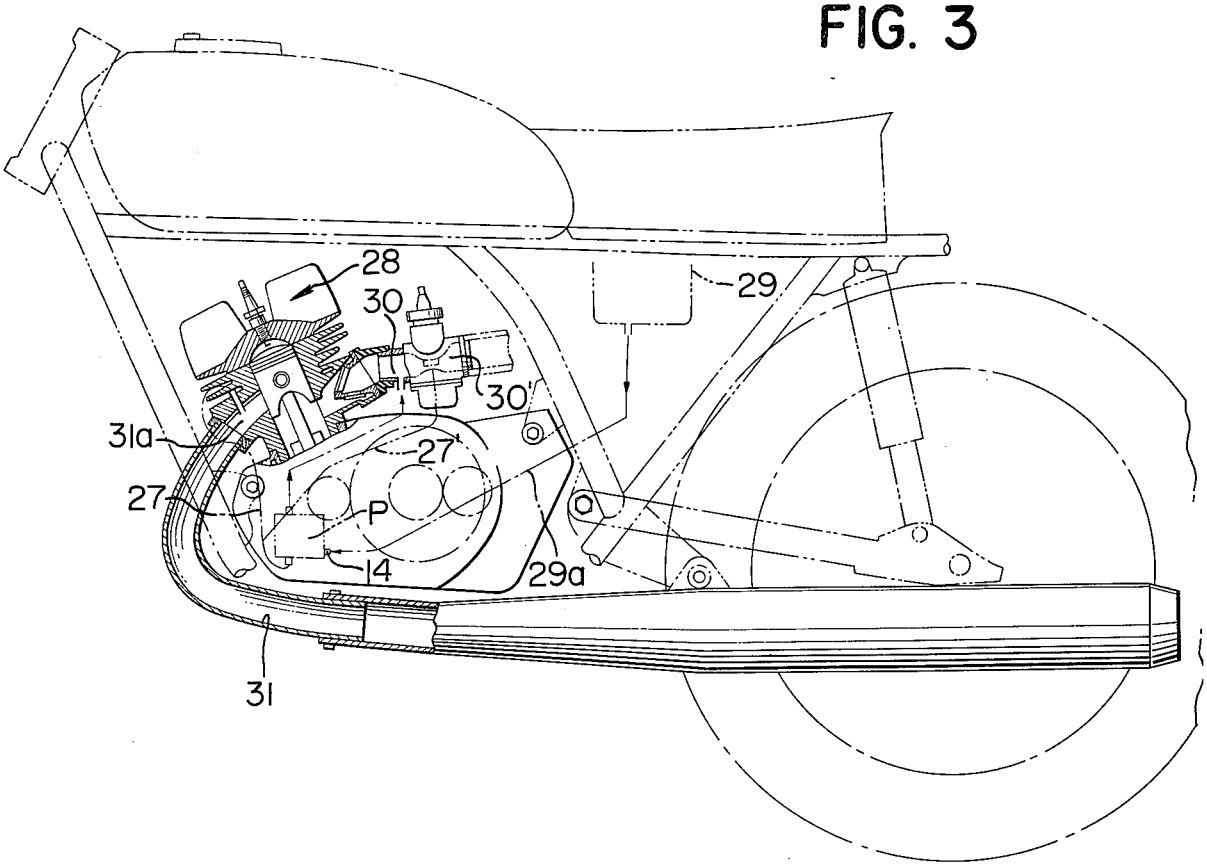
FIG. 3 is a partially sectioned two cycle engine including the lubricating system in accordance with the present invention.

Referring now to FIG. 3, there is shown a motorcycle having a two-cycle engine 28 which includes an intake passage 30 and an exhaust pipe 31. The exhaust pipe 31 is connected with the engine 28 at its exhaust port **31*a*. The motorcycle has an oil tank 29 which is connected through a conduit 29*a* with the inlet port 14 of the pump P. The pressure chamber 26 of the pump P is connected through a conduit 27 with the exhaust port 31*a* of the engine 28**.

Thus, it will be understood that in operation any change in pressure at the exhaust port **31*a* is transmitted through the conduit 27 to the pressure chamber 26. Therefore, the diaphragm 22 and consequently the cam member 20 are moved in the vertical direction whereby the leftward movement of the plunger 5 under the influence of the spring 13 is limited by the cam member 20. In this manner, the stroke of the plunger 5 is adjusted in accordance with the pressure at the exhaust port 31*a* of the engine. Since the pressure of the engine exhaust gas increases in response to an increase in the engine speed as well as to an increase in the throttle valve opening, the aforementioned control can provide a lubricant oil supply by a desirable amount in accordance with the speed and load of the engine. In the arrangement illustrated in FIG. 3, the conduit 27 opens to the exhaust port 31*a*. This is advantageous in that sludges and similar material is burnt or vaporized in this area so that there is least possibility that the conduit 27 is clogged. Further, since the conduit 27 is opened at the upper part of the exhaust port 31*a***, any foreign deposits will be assisted to fall off under gravitational force.

Figure 4:
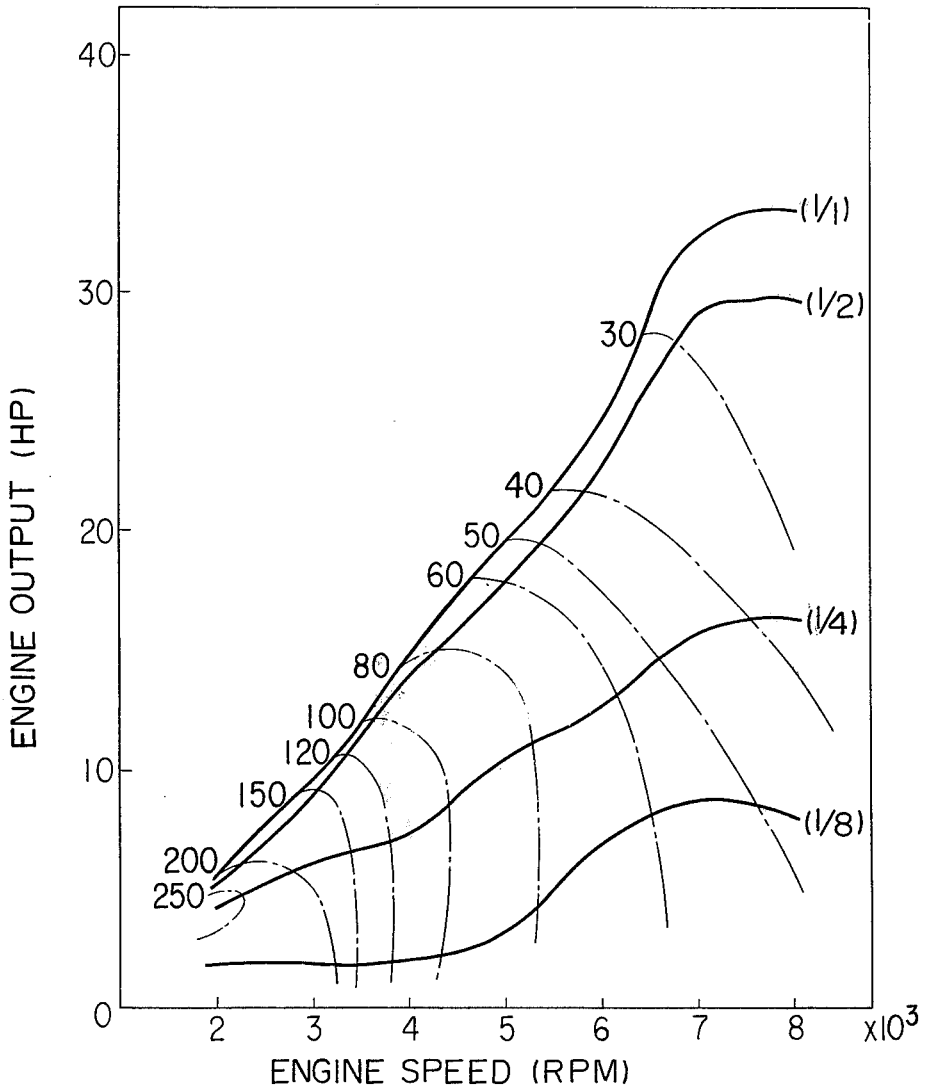
FIG. 4 is a diagram showing the changes in the amount of lubricant oil supply in accordance with one example of the present invention.

FIG. 4 shows equi-mixing-ratio curves in an engine embodying the features of the present invention. In the diagram, the numerals in parentheses represent the throttle opening and the numerals without parentheses represents the mixing ratio of gasoline to lubricant oil. From the diagram, it will be understood that the supply of lubricant oil can be suitably controlled in accordance with the engine speed and with the engine output.

The invention has thus been shown and described with reference to a specific embodiments, however, it should be noted that the invention is in no way limited to the details of the illustrated structures but changes and modifications may be made without departing from the scope of the appended claims.

I claim:

1. In internal combustion engines comprising cylinder means, piston means disposed in said cylinder means for reciprocating movement, intake means including throttle valve means for introducing combustible air-fuel mixture to said cylinder means, exhaust means including exhaust port means and exhaust passage means for exhausting combustion gas from the cylinder means as exhaust gas; lubricant oil pump means comprising plunger means provided for axial reciprocating movement to displace lubricant oil in accordance with stroke of the axial reciprocating movement, means for effecting said axial reciprocating movement of the plunger means, and control means responsive to a pressure of the combustion gas in said exhaust for controlling the stroke of said plunger means whereby supply of lubricant oil for each engine stroke is increased in response both to an increase in the engine speed and to an increase in the engine throttle valve opening.

2. Lubricant oil pump means in accordance with claim 1 in which conduit means is provided for directing pressure of the exhaust gas from the exhaust means to the control means so that the latter is controlled in accordance with the exhaust gas pressure.

3. Lubricant oil pump means in accordance with claim 2 in which said conduit means extends from said exhaust port means.

4. Lubricant oil pump means in accordance with claim 3 in which said conduit means opens to the exhaust port means at upper part thereof.

5. Lubricant oil pump means in accordance with claim 3 in which said conduit means opens to said exhaust means through orifice means.

* * * * *